United States Patent [19]

Kontz

[11] 4,414,048

[45] Nov. 8, 1983

[54] WEB SPLICING APPARATUS

[75] Inventor: Robert F. Kontz, Toledo, Ohio

[73] Assignee: Owens-Illinois, Inc., Toledo, Ohio

[21] Appl. No.: 261,303

[22] Filed: May 7, 1981

[51] Int. Cl.[3] ..... B31F 5/06; B65H 21/00

[52] U.S. Cl. ..... 156/159; 156/304.3; 156/504; 156/505; 242/58.4; 242/58.5

[58] Field of Search ..... 156/157, 159, 304.3, 156/504, 505; 242/58.4, 58.5, 58.1

[56] References Cited

U.S. PATENT DOCUMENTS

| | | | |
|---|---|---|---|
| 3,939,032 | 2/1976 | Taitel et al. | 156/505 |
| 4,081,312 | 3/1978 | Cristiani | 156/504 |
| 4,157,934 | 6/1979 | Ryan et al. | 156/504 |

*Primary Examiner*—Michael G. Wityshyn
*Attorney, Agent, or Firm*—J. R. Nelson; M. E. Click

[57] ABSTRACT

An apparatus for splicing webs from separate web rolls comprising a splicing station across which a web from one roll is moved, a vertically movable brake movable downwardly for engaging the web to momentarily interrupt the web, a fixed knife blade associated with the station beneath the web and a movable knife blade which is movable from a first position above the web to a second position below the web. The apparatus supports the taped end of a web from a second roll in position above the movable knife blade and is operated to move the movable knife blade to sever the trailing end of the web from the first roll and tape the leading end of the second roll to the severed end of the first roll providing a butt splice. The movable knife blade is manually removable from below the spliced web, after being moved downwardly to splice the webs, and is insertable to a position above the second web for a subsequent splicing of the web from the second roll to another roll.

8 Claims, 9 Drawing Figures

WEB SPLICING APPARATUS

This invention relates to web handling apparatus and particularly to apparatus for splicing the trailing end of one roll of stock which is being unreeled from one roll to the leading end of a web which is about to be unreeled from another roll.

BACKGROUND AND SUMMARY OF THE INVENTION

In the handling of webs of material such as expanded plastic, paper and the like, for feeding to various machines that convert the webs into articles such as cups and containers, it is common to provide the web stock on rolls. When the web stock on one roll has been completely depleted, the web stock on the next roll must be provided to the production machine. Accordingly, it is common to manually or automatically splice the trailing end of the one roll from the web which is being fed to the leading end of the next roll from which the web is to be fed to the production machine.

Among the objectives of the present invention are to provide a web splicing apparatus which minimizes the time required for making the splice and which is simple and relatively inexpensive requiring minimum maintenance.

In accordance with the invention, the apparatus for splicing webs embodying the invention comprises means defining a splicing station across which a web from one roll is moved, a vertically movable brake movable downwardly for engaging the web to momentarily interrupt the web, a fixed knife blade associated with the splicing station beneath the web and a movable knife blade which is movable from a first position above the web to a second position below the web. A ram holds the taped end of a web from a second roll in position above the movable knife blade, and means operates the brake and the ram and moves the movable knife blade to sever the trailing end of the web from the first roll and tape the leading end of the second roll to the severed end of the first roll providing a butt splice. The movable knife blade is manually removable from below the spliced web, after being moved downwardly to splice the webs, and is inserted to a position above the second web for a subsequent splicing of the web from the second roll to another roll.

DESCRIPTION

Figure 1:
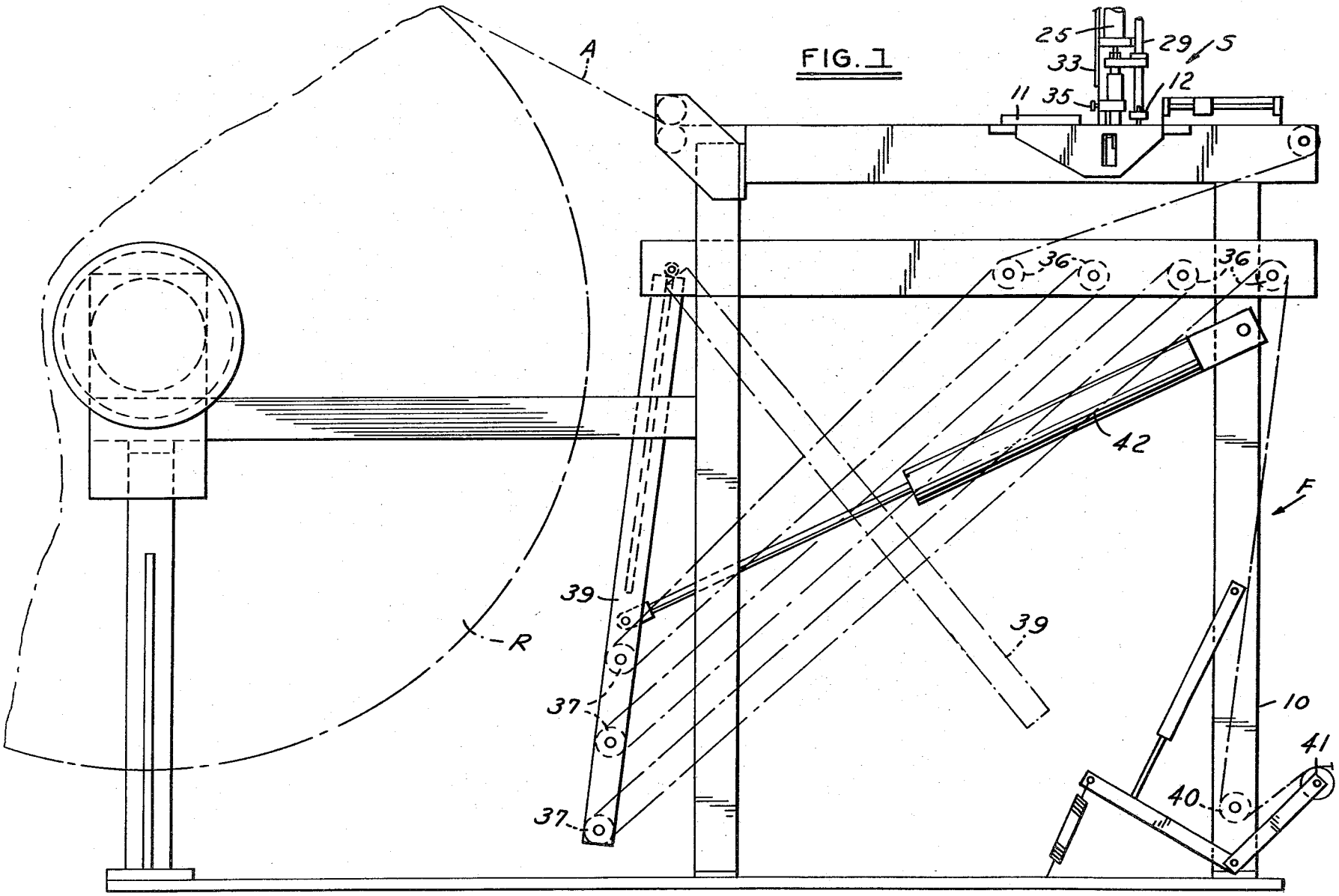
FIG. 1 is a side elevational view of a web handling apparatus embodying the invention.
Figure 2:
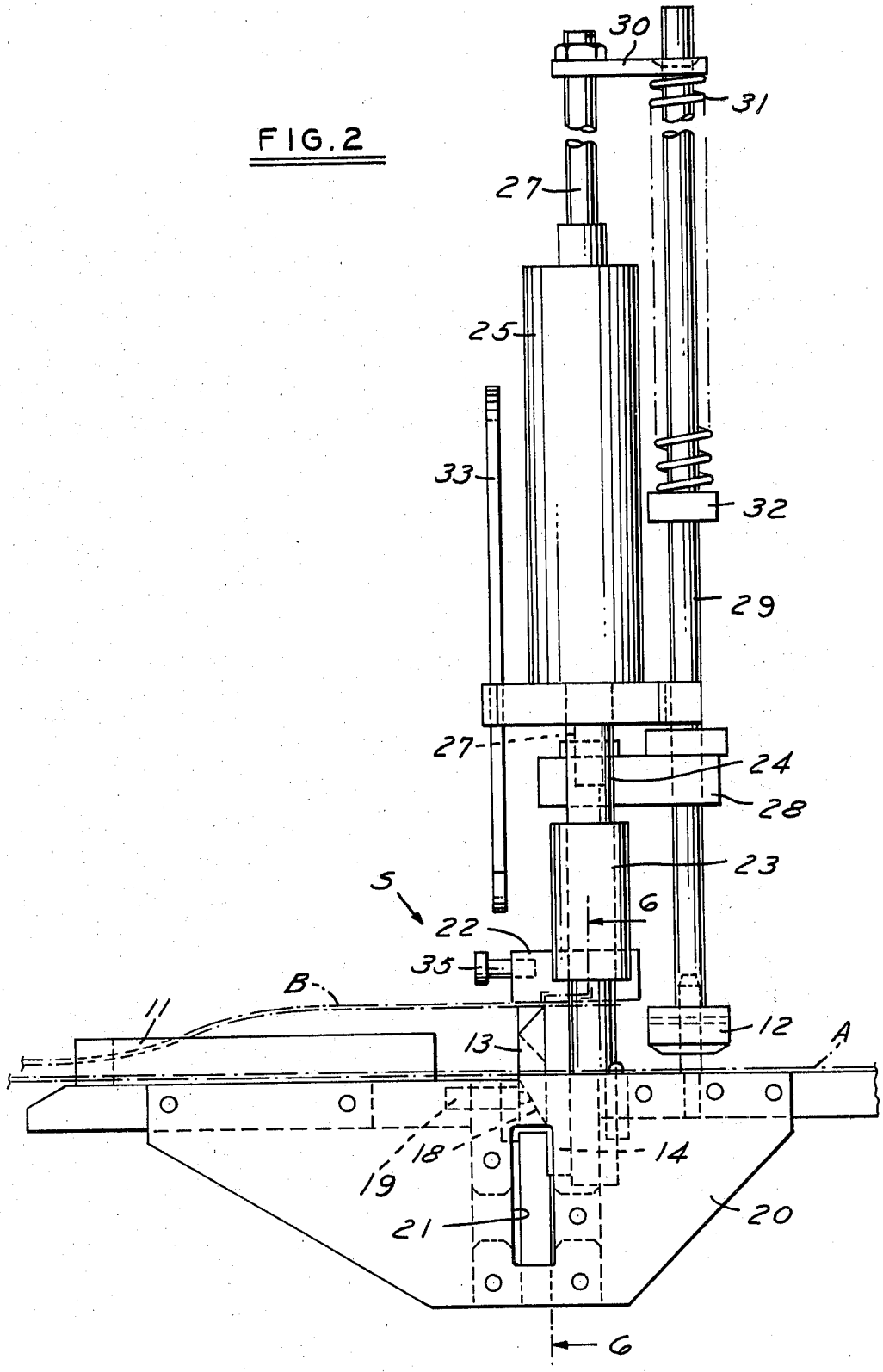
FIG. 2 is a side elevational view on an enlarged scale of the web splicing portion of the apparatus.
Figure 3:
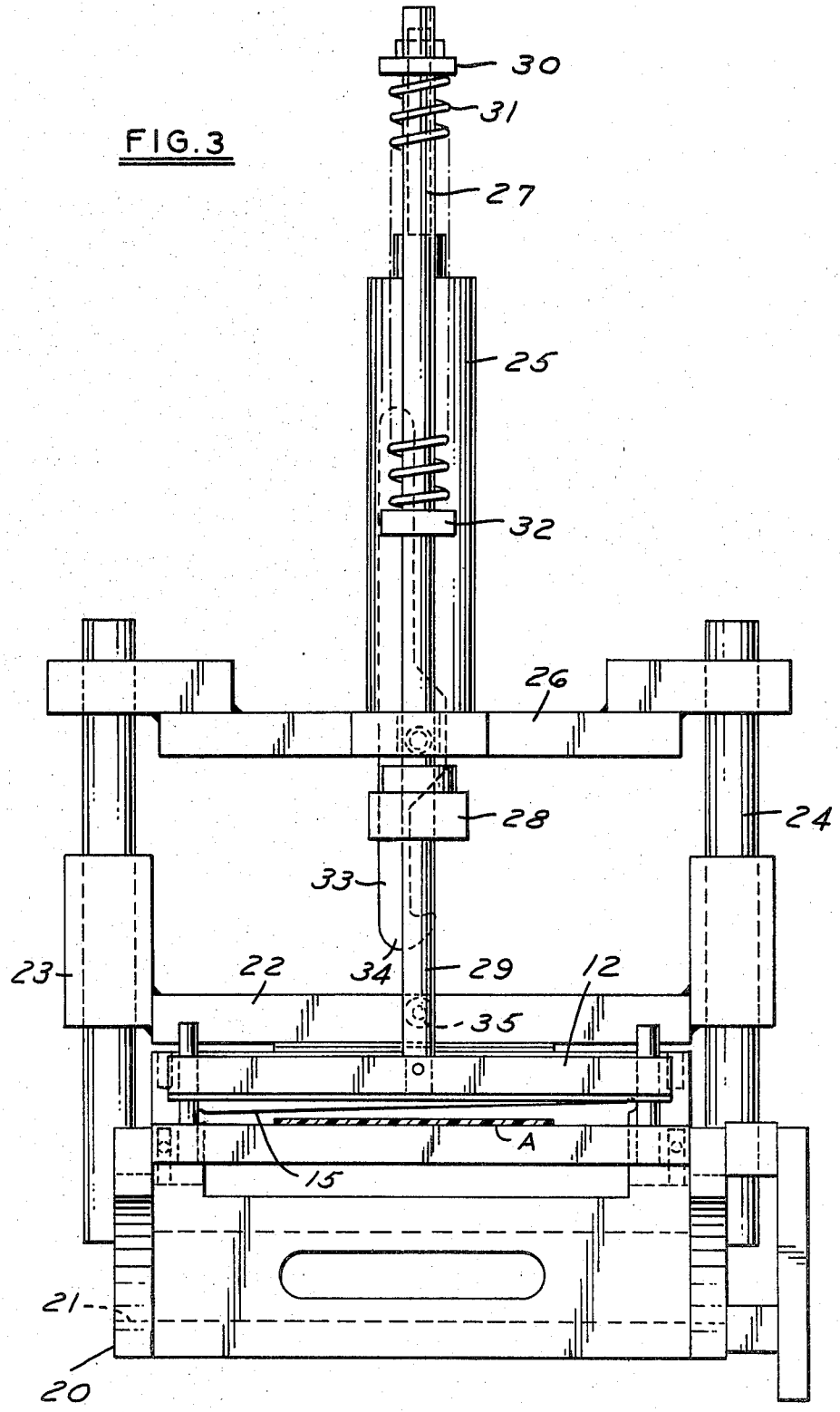
FIG. 3 is a front elevational view taken from the right as viewed in FIG. 1.
Figure 4:
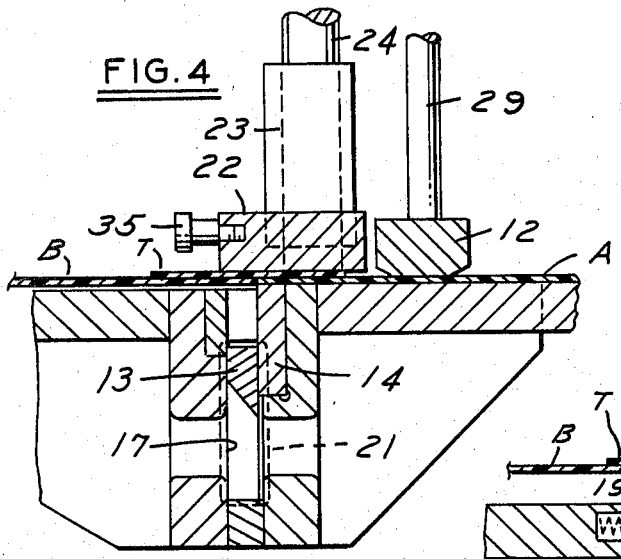
FIGS. 4 and 5 are fragmentary longitudinal sectional views showing the parts in different operating positions.

Referring to FIGS. 1 and 2, the web splicing apparatus comprises a frame 10 that defines a splicing station S including a horizontal support for a web A which is being fed from a first roll R. The web is shown as comprising an expanded plastic material to be utilized for making hollow articles but may also comprise paper, plastic film, or the like. Guides 11 center the web horizontally as it moves through the splicing apparatus. As shown in FIGS. 2 and 3, the splicing apparatus includes a brake pad or shoe 12 in the form of a horizontal bar that is actuated downwardly to momentarily interrupt the movement of the web A so that a movable knife blade 13 (FIG. 6) can be moved downwardly to sever the trailing end of the web A and attach the taped leading end of a web B to the trailing end of the web A.

Figure 6:
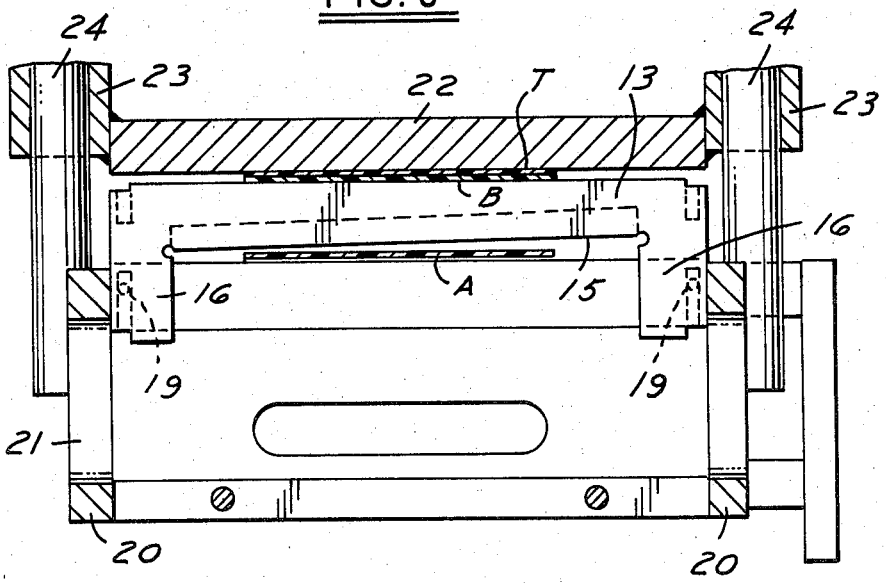
FIG. 6 is a fragmentary sectional view taken along the line 6—6 in FIG. 2.
Figure 7:
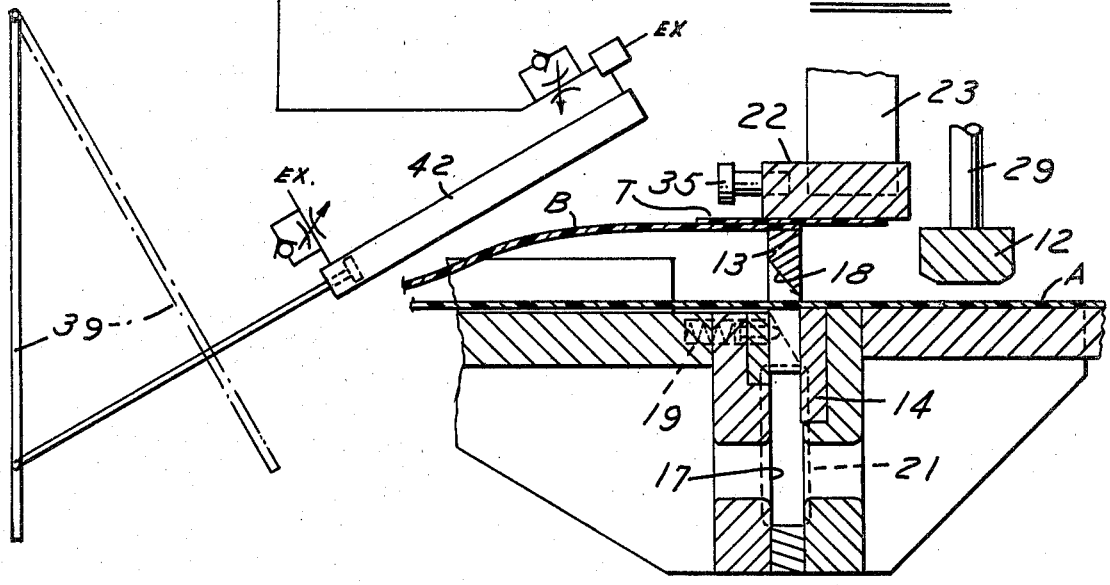
FIG. 7 is a fragmentary sectional view similar to FIGS. 3 and 4 showing the parts in a different operative position.

As shown in FIG. 7, the movable knife blade 13 functions in cooperation with a fixed knife blade 14. The movable knife blade 13 includes a cutting edge 15 (FIG. 6) and side portions 16 which guide the blade in a vertical track 17 at each end of the blade and at the sides of the apparatus. The movable blade 13 includes a longitudinally extending beveled surface 18 that extends downwardly and forwardly on the rear face of the blade for engagement with springloaded detents 19 when the blade is in the raised position shown in FIGS. 2 and 7. This holds the movable knife 13 so that the web A is moving below the knife 13 toward the production machine.

Figure 8:
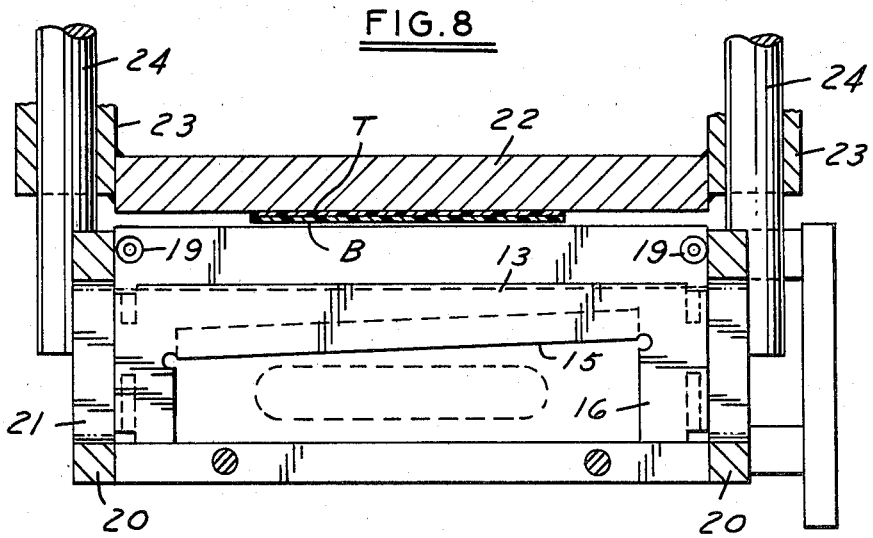
FIG. 8 is a fragmentary sectional view similar to FIG. 5 showing the parts in a different operative position.

As shown in FIGS. 2, 6 and 8, the apparatus includes side plates 20 having elongated vertical openings 21 so that the movable knife 13 can be manually removed after it has been moved downwardly, as presently described.

The actuation of the movable knife 13 downwardly to sever the trailing end of a web is achieved by a transverse bar 22 forming part of a bridge with guides 23 on the ends thereof vertically movable on spaced shafts 24 mounted on the frame. The bar 22 is movable vertically by an actuator 25 mounted on a transverse frame member 26 fixed to the upper end of the shafts 24 (FIG. 3). The actuator piston shaft 27 of the actuator 25 has a ram 28 thereon that engages the transverse bar 22 to move the bar 22 vertically.

The brake pad 12 extends transversely of the apparatus and is mounted on an operating rod 29 vertically movable through an opening in ram 28. The upper end of the actuator piston shaft 27 has a bar 30 fixed thereto which also is fixed to the upper end of the brake pad rod 29 (FIG. 2). A helical spring 31 is interposed between the bar 30 and a collar 32 fixed on the rod 29.

By this arrangement, when the cylinder 25 is acutated to move the ram 28 downwardly, the rod 29 first moves the brake pad 12 into contact with the top surface of web A. Continued movement of the actuator piston shaft 27 downwardly moves the ram 28 into contact with the transverse bar 22 causing the movable knife 13 to be moved downwardly so that its cutting edge cooperates with the fixed knife blade 14 to cut the trailing edge of the web that is being fed.

A latch 33 is pivoted to frame member 26 and has a hook 34 for engaging a pin 35 on the bar 22 to hold the bar 22 in upward position in preparation for splicing (FIGS. 2, 3).

Figure 5:
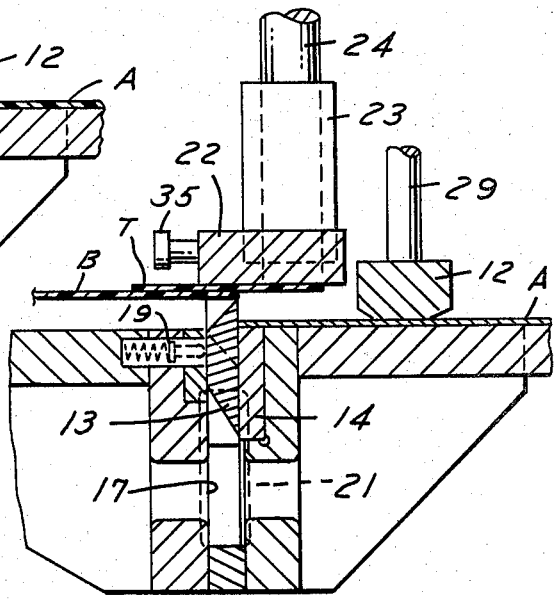

In preparation for splicing, a tape T (FIGS. 5 and 7) is applied to the leading end of the fresh web B from the second roll which is to be spliced to the trailing end of the web A of the first roll and positioned between the bar 22 and the movable knife 13, the bar 22 having been unlocked from the latch 33 (FIG. 7).

As the trailing end of web A approaches the splicing station S, the apparatus is actuated by applying air to the actuator 25. Movement of shaft 27 of the actuator first moves the brake 12 downwardly into engagement with the web A to momentarily stop the web A and thereafter severs the trailing end of web A by movement of the bar 22 downwardly to force the movable knife 13 downwardly against the action of the detents 19 so that the cutting edge 15 of the movable knife 13 cooperates with the fixed knife 14 to sever the trailing end of web A. This same movement forces the tape T into engagement with the freshly cut trailing end of the web A producing the splice. The actuator piston shaft 27 is then returned immediately to its upward position elevating the brake pad 12 out of engagement with the top surface of web A and permitting the spliced web B to be fed to the production machine. This entire operation can be performed quickly, thus minimizing the effect of interruption of the feed to the production machine.

After the splice has been made, the movable knife 13 is below the web B which is being fed to the production apparatus. The knife can then be removed manually through the slot 21 and positioned above the moving web B so that it is ready for splicing of the leading end of a fresh roll of stock to the trailing end of the web B.

In practice, an accumulator or festooning apparatus F can be utilized to provide sufficient web downstream of the splicing apparatus or, in the alternative, a loop of the web can be accumulated downstream of the splicing apparatus before the splice is made.

As shown in FIG. 1, the festooning apparatus F comprises a plurality of rollers 36 mounted on the frame 10 and rollers 37 mounted on a bar 39 pivoted to the frame 10. The web to be accumulated is fed over the rollers and then over a fixed guide roller 40 and a spring-loaded roller 41 to the production machine. During the splicing operation, when the movement of the web is momentarily interrupted, a pneumatic actuator 42 progressively swings the bar 39 counterclockwise as viewed in FIG. 1, permitting the accumulated web to continue to supply web to the production machine so that the operation of the machine is not interrupted. Upon completion of the splice, the pneumatic actuator 42 is actuated to return the bar 39 to its original solid line position as viewed in FIG. 1 so that a new supply of web can be accumulated for use in a subsequent splicing operation.

Figure 9:
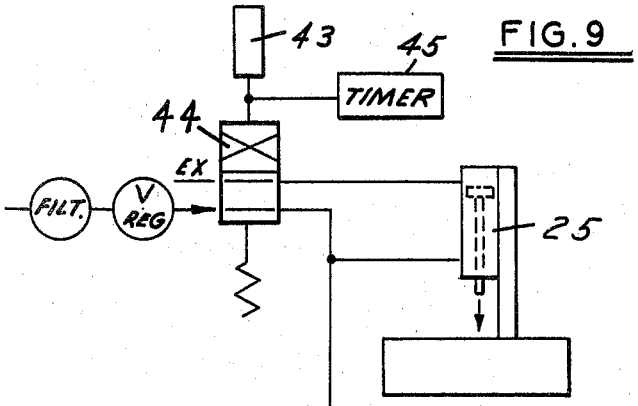
FIG. 9 is a schematic of a control circuit.

FIG. 9 is a schematic diagram of the pneumatic circuit for the splicing apparatus. When a splice is to be performed, the operator initiates the splicing operation by manually positioning the tape between the operating member and the knife as shown in FIG. 7. The operator then actuates a solenoid 43 to operate a valve 44 to supply air to cylinder 25 and move the brake 12 and then the movable knife 13 downwardly under the action of the actuator. The solenoid 43 controls the valve 44 which, in turn, controls the flow of air to the actuator. Simultaneously, the valve controls the exhaust from the festooning pneumatic actuator 42 so that the actuator 42 functions to progressively permit the portion of the web in the festooning apparatus F to continue to pass to the production machine while the splice is being achieved. A timer 45 controls the operation of the valve 44 so that after a predetermined time delay, the cylinder is returned to its original position and fluid is supplied to the festooning pneumatic actuator 42 to return it to its original position for further accumulation of the new web in preparation for the next splicing cycle.

I claim:

1. An apparatus for splicing webs from separate web rolls comprising means defining a substantially horizontal splicing station across which a web from one roll is moved, a vertically movable brake movable downwardly for engaging the web to momentarily interrupt the web, a movable knife blade, means for guiding the movable knife blade for movement from a first position above the web to a second position below the web, detent means for holding the movable knife blade in said first position above the web, a fixed knife blade associated with said splicing station beneath the web, a vertically movable bar above said movable knife for holding the taped end of a web from a second roll in position between the movable knife blade in its first position and said bar disposed above the web from the first roll, said bar operable for driving said movable knife downwardly to its second position below the web and carrying the tape and second web to the first web, and drive means for moving said brake into engagement with said web and moving said bar to drive said movable knife blade, thereby severing the trailing end of the web from the first roll, and taping the leading end of the second roll to the severed end of the first roll in a butt splice thereof, said apparatus including a transverse opening so that the movable knife blade may be manually removed while at its said second position after severing the web and inserted to its first position above the second web for a subsequent similar splicing of the second web to another roll.

2. The apparatus set forth in claim 1 wherein said drive means comprises a motor, an actuator, a lost motion means connected between the actuator and the brake, and a shaft connected to said bar for moving it and said movable knife.

3. A method for splicing webs from separate web rolls comprising moving a web from a first roll across a splicing station, positioning a movable knife blade on one side of the web at the splicing station, positioning a fixed knife blade on the other side of the web at the splicing station, holding the taped end of a web from a second roll in position interposed between a bar and the movable knife blade, interrupting the movement of the web at the splicing station, driving the bar toward the web thereby moving the movable knife blade to sever the trailing end of the web from the first roll and tape the leading end of the second roll to the severed end of the first roll providing a butt splice, manually removing the movable knife blade from the other side of the web after being moved through the web to sever it, and positioning the movable knife blade on said one side of the web of the second roll after the butt splice is made for subsequently splicing the web of the second roll to a web from another roll.

4. An apparatus for splicing webs from two separate web rolls comprising means defining a splicing station across which a web from one roll is moved, a brake shiftable toward the moving web for engaging the web to momentarily interrupt its movement across the splicing station, a movable knife blade, guide means defining the path of movement for said knife blade from a first position on one side of the web to a second position on the other side of the web whereat said knife blade is free of said guide means, yieldable means for holding said knife blade in said first position, a fixed knife blade associated with said splicing station on other side of the web cooperating with the movable knife blade to sever the web, bar means on the one side of the web at the splicing station adapted for holding the taped end of a web from a second roll in position, the movable knife blade in its first position holding said taped end against the bar means and adapted for movement toward said first web together by movement of said bar means in that direction, and means for operating said bar means driving said movable knife blade from its first position to its second position to sever the trailing end of the web of the first roll, and concurrently therewith and, in succession with such severing action, tape the leading end of the web of the second roll to the severed end of the first roll thereby providing a butt splice of the two ends, said movable knife blade being free for removal from the guide path after being actuated to its said second position.

5. The apparatus of claim 4 in which said yieldable means comprises a spring-loaded detent supported at the splicing station yieldably engaging said movable knife blade for holding it in said first position.

6. The apparatus of claim 4 in which the movable knife blade is removable from its said second position and insertable in its said first position after completing the butt splice in the web and without disturbing the web for subsequent further use in splicing webs at the splicing station.

7. The apparatus of claim 4, wherein the bar means comprises a transverse bar for straddling the web, parallel guides engaging said bar and guiding it in movement toward and away from the web, and the means for operating said bar means comprises a reciprocating motor operatively connected to said bar means for driving the latter.

8. The apparatus of claim 7 in which the brake is operatively connected to said reciprocating motor for operatively shifting said brake into engagement with the web in such a manner that the brake is first engaged on the web, and thereafter in succession said bar means is operated to sever the web of the first roll and splice the end of the web of the second roll thereto.

* * * * *